United States Patent [19]

Klaus

[11] Patent Number: 4,473,227

[45] Date of Patent: Sep. 25, 1984

[54] BASEBALL PITCHERS' PRACTICE DEVICE

[76] Inventor: Louis Klaus, 70-20 Parsons Blvd., Flushing, N.Y. 11365

[21] Appl. No.: 546,550

[22] Filed: Oct. 28, 1983

[51] Int. Cl.[3] ..... A63B 69/40

[52] U.S. Cl. ..... 273/26 A; 273/DIG. 30

[58] Field of Search ..... 273/26 A, 26 R, 30, 273/29 A, 411, 348, 366, 367, 393, 404, 55 D

[56] References Cited

U.S. PATENT DOCUMENTS

| | | | |
|---|---|---|---|
| 708,569 | 9/1902 | Manley | 273/26 A |
| 928,674 | 7/1909 | Zenz | 273/26 A |
| 1,142,184 | 6/1915 | Lawrence | 273/26 A |
| 1,599,005 | 7/1926 | Rovane | 273/26 A |
| 2,126,102 | 8/1938 | Fowler | 273/26 A |
| 3,312,467 | 4/1967 | Dawson | 273/26 A |
| 3,450,405 | 6/1969 | Mates | 273/29 A |
| 3,583,703 | 6/1971 | Brown | 273/26 A |
| 3,591,180 | 7/1971 | Lafon, Sr. | 273/393 |
| 3,633,909 | 1/1972 | Doynow | 273/26 A |
| 3,908,992 | 9/1975 | Cunningham | 273/55 D |
| 4,188,031 | 2/1980 | Fox | 273/26 A |

*Primary Examiner*—Richard C. Pinkham
*Assistant Examiner*—T. Brown
*Attorney, Agent, or Firm*—Richard L. Miller

[57] ABSTRACT

A baseball pitchers' practice device is provided and consists of a vertical support frame set up temporarily at the front edge of home plate. The pitcher attempts to throw the baseball from his mound position to the catcher behind home plate through the device which outlines the strike zone area. The support frame is comprised of a pair of spaced apart, vertically extending stanchions. Each stanchion is supported by base members, the base members being connected by a horizontally extending alignment rod. The stanchions are attached to the base members by spring members such that if the stanchions are hit by a pitched ball the stanchions will be deflected. The strike zone area is defined by a plurality of strips of tape and is releasably attached to the stanchions by loop-hook fabric fasteners such that the tape will be disengaged from the stanchions if hit by a pitched ball.

8 Claims, 7 Drawing Figures

BASEBALL PITCHERS' PRACTICE DEVICE

BACKGROUND OF THE INVENTION

The instant invention relates generally to baseball and more specifically it relates to a baseball pitchers' practise device.

In a baseball game a strike is charged against a batter if he fails to swing at a pitched baseball that crosses home plate in the strike zone (an area over home plate and between the batter's knees and the batter's armpits, being a rectangle 2 feet above home plate approximately 22 inches wide by 40 inches high).

SUMMARY OF THE INVENTION

The baseball pitchers' practise device is for the purpose of training and assisting in the development and maintaining the skill of baseball pitchers; to familiarize them more adequately with the "strike zone" at home plate. This device is a practice device set up temporarily at the front edge of home plate. The pitcher attempts to throw the baseball from his mound position to the catcher behind home plate through the device which outlines the "strike zone".

This device, with continued practice, should imprint in auto-suggestive manner the position of the "strike zone" thereby resulting in better pitching, control, making the pitcher more effective in his efforts to subdue the opposing batters.

This device may also be used as a training and skill sharpening device for baseball umpires, who working behind the home plate, must follow the course of the pitched ball to ascertain whether the throw is "strike" or a "ball" (in baseball terminology).

A principle object of the present invention is to provide a baseball pitchers' practise device that is used for training and control for pitching through the "strike zone" thus improving the pitcher's control to strike out batters and/or pitching to the batter's weaknesses.

Another object is to provide a baseball pitchers' practise device that during practice use with the device, the pitching coach occupying a position behind the catcher has a better opportunity to study the pitcher's form and work, with an increased ability to improve the pitcher's quality.

An additional object is to provide a baseball pitcher's practise device that has use for umpires in their training schools and camps, to improve their work behind home plate calling balls and strikes.

A further object is to provide a baseball pitchers' practise device that is simple and easy to use.

A still further object is to provide a baseball pitchers' practise device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the invention.

FIG. 2 is an enlarged cross sectional view taken along line 2—2 in FIG. 1. FIG. 3 is an enlarged cross sectional view taken along line 3—3 in FIG. 1. FIG. 4 is an enlarged perspective illustrating a construction detail of the invention. FIG. 5 is an enlarged cross sectional view taken along line 5—5 in FIG. 1.

DESCRIPTION OF THE PREFERRED EMBODIMENT

Figure 1:
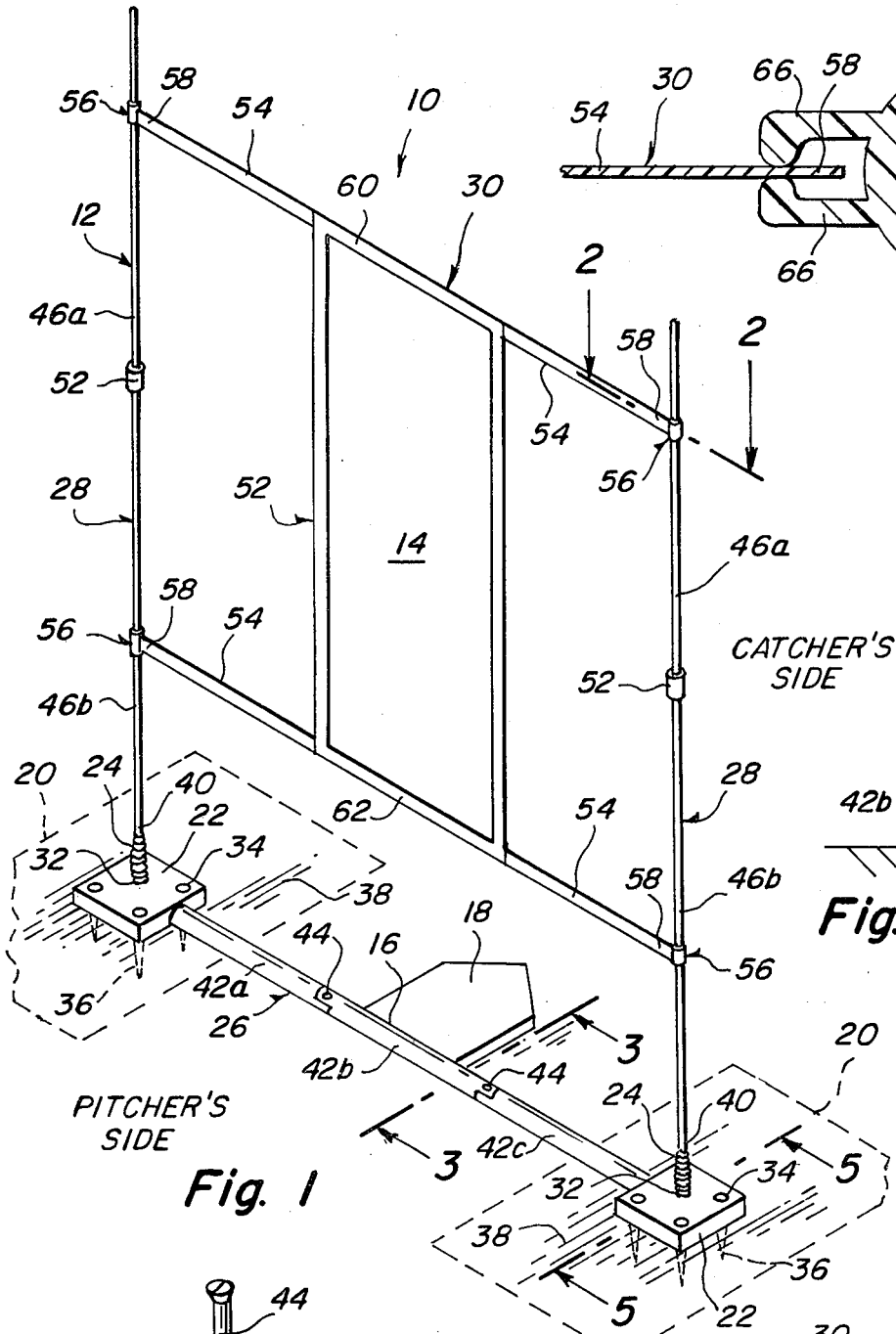
Figure 2:
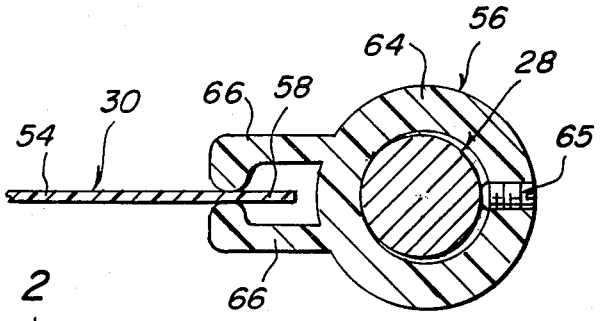
Figure 7:
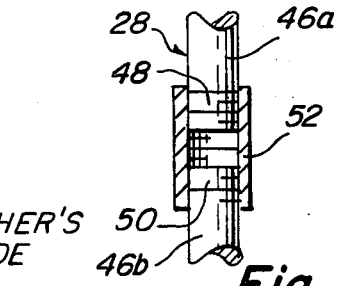
FIG. 7 is an enlarged cross sectional view of a typical coupling for an upright stanchion.
Figure 3:
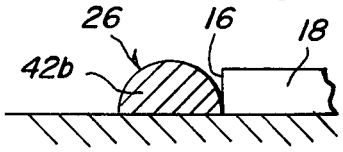
Figure 5:
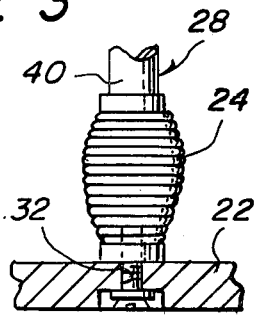
Figure 4:
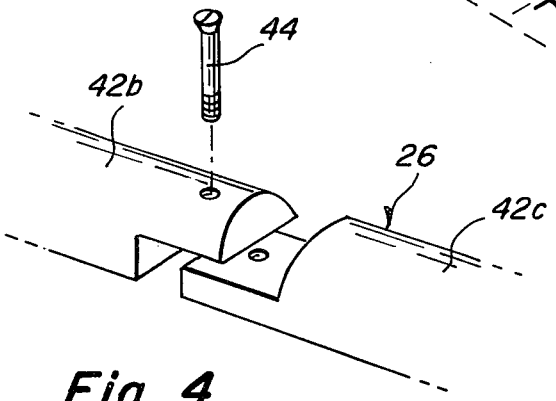

Turning now descriptively to the drawing in which similar reference characters denote similar elements throughout the several views, FIGS. 1 through 7 illustrates a baseball pitchers' practise device 10 that consists of a vertical support frame 12 having a strike zone area 14 outlined and suspended therefrom. The support frame 12 is set up temporarily at front edge 16 of home plate 18 between batter's boxes 20,20 whereby a pitcher (not shown) attempts to throw a baseball (not shown) from his mount position to a catcher (not shown) behind home plate 18 through the strike zone area 14 of the device 10.

The vertical support frame 12 consists of a pair of base members 22,22 a pair of spring assemblies 24,24 an alignment rod 26, a pair of upright stanchions 28,28 and a strike zone frame 30.

Each base member 22 has a central aperture 32 and corner apertures 34 to accommodate spikes 36 for holding the base member 22 to ground 38. Each spring and ball joint assembly 24 is affixed to the central aperture 32 of the vase member 22 to allow 180 degree movement if struck. The alignment rod 26 is affixed between the base members 22,22 to set the device 10 in line and position in front of home plate 18. Each stanchion 28 has one end 40 affixed to the spring and ball joint assembly 24. The strike zone frame 30 is supported between the upright stanchions 28,28.

The alignment rod 26 is in three sections 42*a*, 42*b*,42*c* that are assembled by two bolt fasteners 44 so that they can easily be disassembled and stored.

Each upright stanchion 28 is in two sections, 46*a* and 46*b*. The upper section 46*a* has a threaded bottom end 48 while the lower section 46*b* has a threaded top end 50. The two sections are assembled by a threaded union 52 engaging the threaded bottom end 48 of the upper section 46*a* and the threaded top end 50 of the lower section 46*b* so that they can easily be disassembled and stored.

The strike zone frame 30 consists of a vertical rectangular strike zone member 52, two sets of horizontal support arms 54 and a device 56 for fastening free ends 58 of the support arms 54 to the upright stanchions 28,28.

The vertical rectangular strike zone member 52 is approximately 22 inches wide by 40 inches high. One set of support arms 54,54 are connected between top 60 of the strike zone member 52 and the upper sections 46*a*, 46*a* of the upright stanchions 28,28 while the other set of support arms 54,54 are connected between bottom 62 of the strike zone member 52 and the lower sections **46*b*, 46*b* of the upright stanchions 28,28. The bottom 62 of the strike zone member 52 will be about 2 feet above home plate 18**.

The strike zone member 2 is formed from 1 inch woven nylon tape that has a bright color, such as yellow or fluorescent orange, on pitchers facing side and black color on catcher's facing side. The support arms 54 are formed from 1 inch black woven nylon tape.

The device 56 for fastening free ends 58 of the support arms 54 to the upright stanchions 28 are clips 64 having spring jaws 66. Each clip 64 adjustably fits over each stanchion 28 with the spring jaws 66 engaging the free end 58 of the support arm tape 54 that is easily released if the strike zone frame 30 is struck by a baseball.

Figure 6:
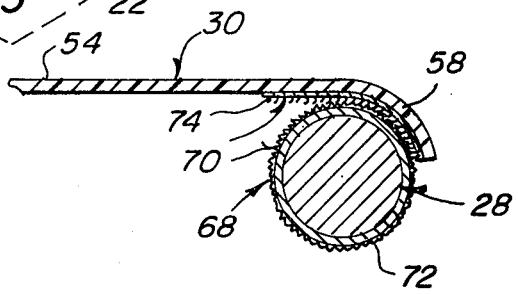
FIG. 6 is an enlarged cross sectional view similar to FIG. 2 showing another type of fastener.

FIG. 6 shows another device 68 for fastening free ends 58 of the support arms 54 to the upright stanchions 28. The device 68 consists of loop-hook fabric fasteners 70. One portion 72 of one loop-hook fabric fastener 70 is affixed around one stanchion 28 while other portion 74 is affixed to a free end 58 of one support arm 54. If the strike zone frame 30 is struck by a baseball the loop-hook fabric fastener 70 will disengage.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A baseball pitchers' practice device which comprises a vertical support frame having a strike zone area outlined and suspended therefrom, said support frame is set up temporarily at the front edge of home plate between batter's boxes whereby a pitcher attempts to throw a baseball from his mound position to a catcher behind home plate through the strike zone area of said device, said vertical support frame comprising:

(a) a pair of base members, each said base member having a central aperture and corner apertures to accommodate spikes for holding said base member to the ground;

(b) a pair of spring assemblies, each said spring assembly affixed to the central aperture of said base member to allow 180 degree movement if struck;

(c) an alignment rod affixed between said base members for positioning and aligning said device in front of home plate;

(d) a pair of upright stanchions, each said stanchion having one end affixed to said spring assembly;

(e) a strike frame, and (f) coupling means for releasably coupling said strike zone frame to said upright stanchions, whereby the strike zone frame can be automatically released upon its being hit by a pitched baseball, and whereby the stanchions will deflect if hit by a pitched baseball, so as to avoid injury to a catcher during use of said device.

2. A baseball pitchers' practise device as recited in claim 1 wherein said alignment rod is comprised of a plurality of sections which are releasably connected by bolt fasteners so that they can easily be disassembled and stored.

3. A baseball pitchers' practise device as recited in claim 2 wherein each said upright stanchion is comprised of an upper section and a lower section, said upper section having a threaded bottom and said lower section having a threaded top end, the two sections being connected by a threaded union engaging the threaded bottom end of the upper section and the threaded top end of the lower section so that they can easily be disassembled and stored.

4. A baseball ptichers' practice device as recited in claim 3, wherein said strike zone frame comprises:

(a) a rectangular strike zone member approximately 22 inches wide by 40 inches high;

(b) two sets of horizontal support arms, one set of support arms being connected between the top of said strike zone member and the upper sections of the upright stanchions while the other set of support arms is connected between the bottom of said strike zone member and the lower sections of the upright stanchions so that the bottom of said strike zone member will be about 2 feet above home plate.

5. A baseball pitchers' practise device as recited in claim 4 wherein said strike zone member is formed from one inch wide woven nylon tape having a bright color on one side and black color its other side.

6. A baseball pitchers' practise device as recited in claim 5, wherein said support arms are formed from one inch wide black woven nylon tape.

7. A baseball pitchers' practise device as recited in claim 6 wherein said coupling means are clips having spring jaws, each said clip adjustably fits each said stanchion with the spring jaws releasably engaging said support arm tape that is easily released if said strike zone frame is struck by a baseball.

8. A baseball pitchers' practice device as recited in claim 6 wherein said coupling means are loop-hook fabric fasteners, a portion of one said loop-hook fabric fastener is affixed around said stanchions and another portion of said loop-hook fabric fastener is affixed to said support arms, said support arms being wrapped less than 180 degrees around said stanchions so that if said strike zone frame is struck by a baseball said loop-hook fabric fastener will automatically disengage.

* * * * *